US006053114A

United States Patent [19]

Villanueva

[11] Patent Number: 6,053,114

[45] Date of Patent: Apr. 25, 2000

[54] ADJUSTABLE STORAGE RACK

[76] Inventor: Robert Villanueva, 4711 Cumberland Cir., El Paso, Tex. 79903-1923

[21] Appl. No.: 09/021,947

[22] Filed: Feb. 11, 1998

Related U.S. Application Data

[63] Continuation-in-part of application No. 08/746,997, Nov. 19, 1996, Pat. No. 5,746,139.

[51] Int. Cl.[7] ..... A47B 57/10

[52] U.S. Cl. ..... 108/96; 108/107; 211/36

[58] Field of Search ..... 108/92, 96, 107, 108/91, 106; 211/36, 175, 187, 186

[56] References Cited

U.S. PATENT DOCUMENTS

| | | | |
|---|---|---|---|
| 2,406,786 | 9/1946 | Auckland . | |
| 4,109,961 | 8/1978 | Opsvik . | |
| 4,121,377 | 10/1978 | Allen et al. . | |
| 4,173,934 | 11/1979 | Searby . | |
| 4,500,146 | 2/1985 | Peterson . | |
| 4,596,185 | 6/1986 | Wenger | 108/107 X |
| 4,646,655 | 3/1987 | Robolin | 108/92 |
| 4,836,622 | 6/1989 | Ferguson | 108/92 X |
| 5,088,420 | 2/1992 | Russell | 108/96 X |
| 5,167,191 | 12/1992 | Muth | 108/107 X |
| 5,357,873 | 10/1994 | Hilton | 108/92 X |
| 5,408,939 | 4/1995 | Lechman | 108/107 |
| 5,802,987 | 9/1998 | Bellak et al. | 108/108 |

*Primary Examiner*—Peter M. Cuomo
*Assistant Examiner*—Hanh V. Tran
*Attorney, Agent, or Firm*—Laubscher & Laubscher

[57] ABSTRACT

An adjustable storage rack for books includes a frame having a U-shaped horizontal base, a pair of upwardly extending support members and a brace connecting the upper ends of the support members. A plurality of adjustable shelves have end portions connected between the support members and are arranged in a spaced parallel stair-step configuration.

2 Claims, 7 Drawing Sheets

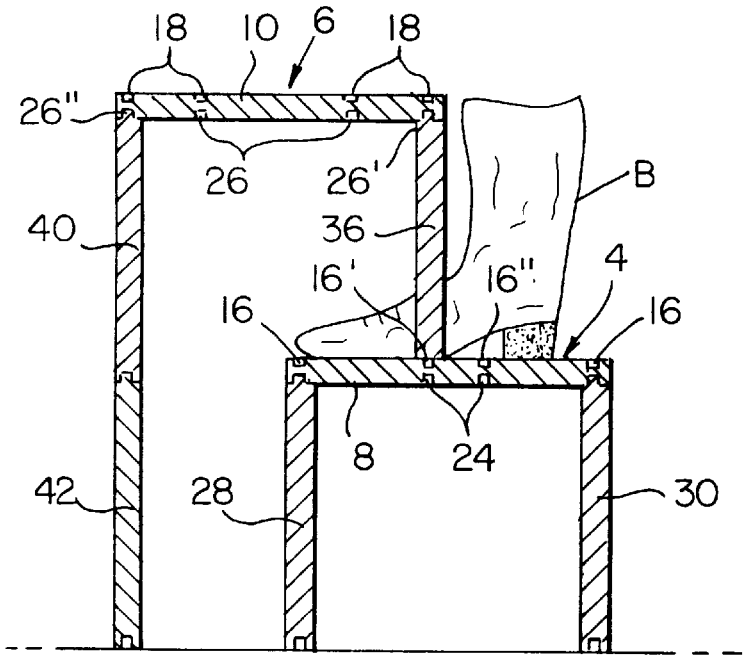
FIG. 2
FIG. 3A
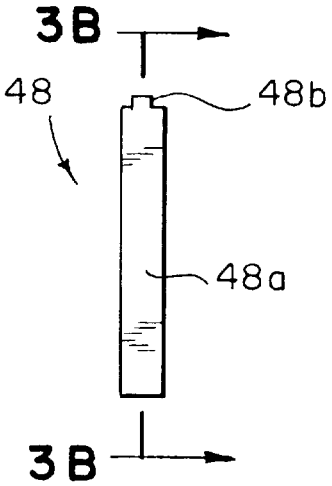
FIG. 3B
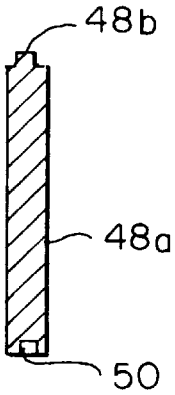
FIG. 7
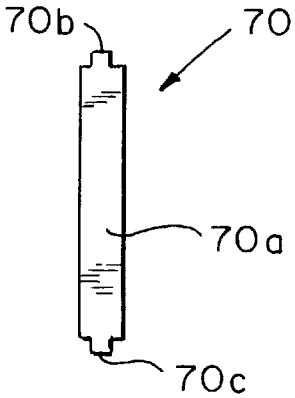

FIG. 8
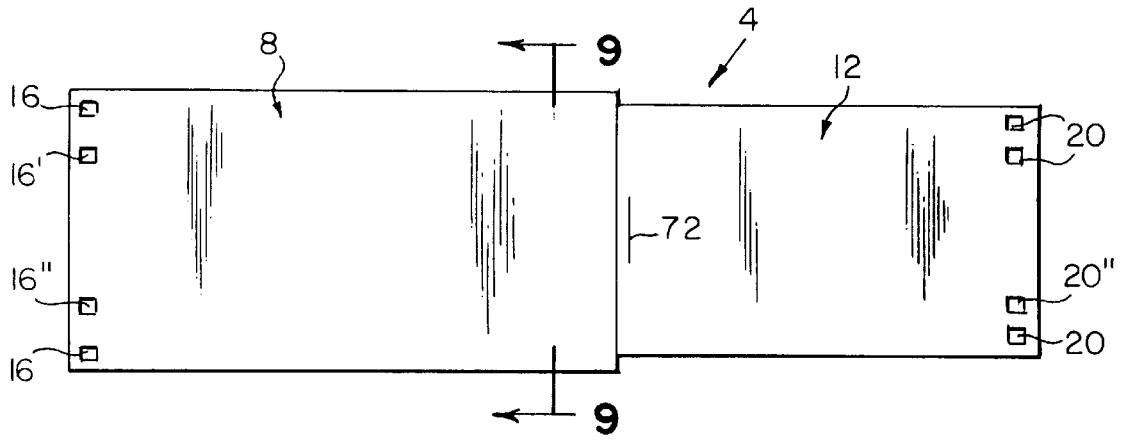
FIG. 9
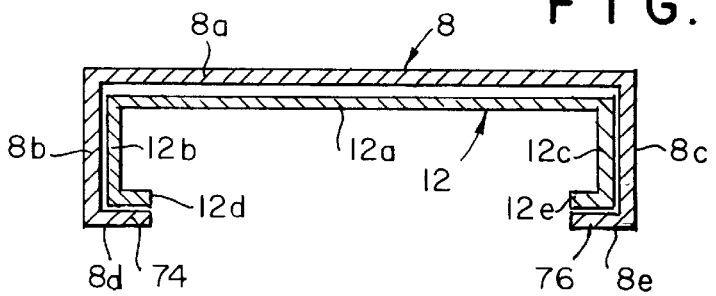
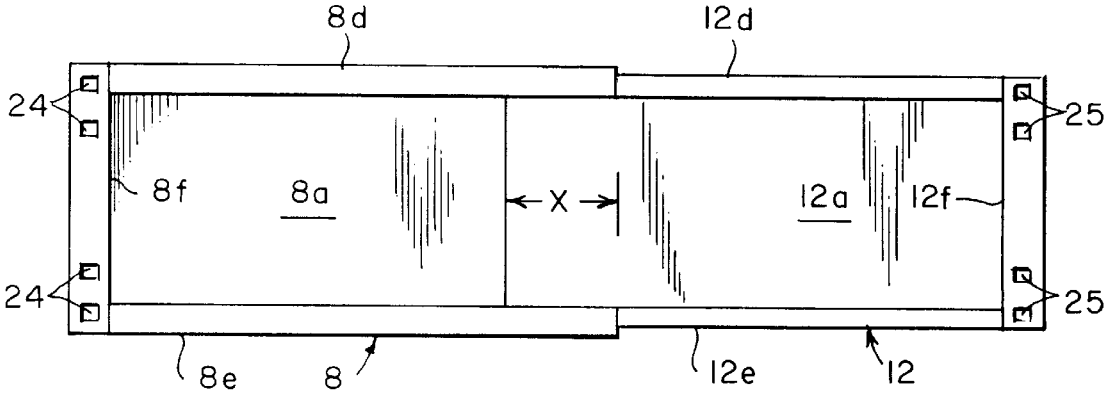
FIG. 10

FIG. 13
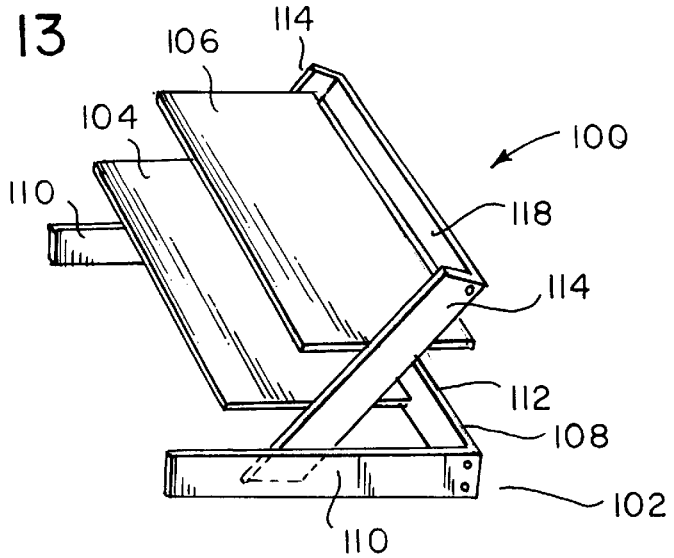
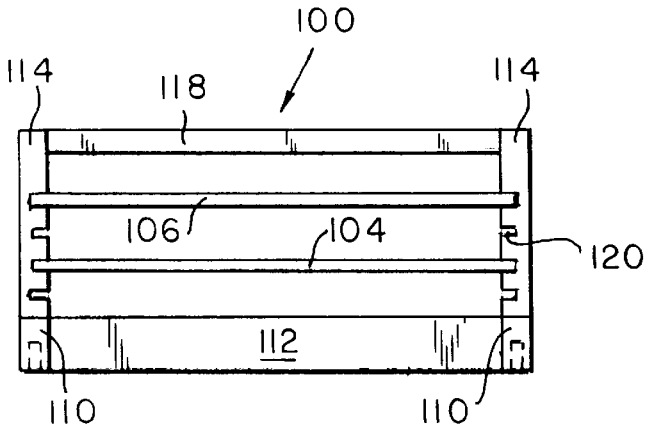
FIG. 14
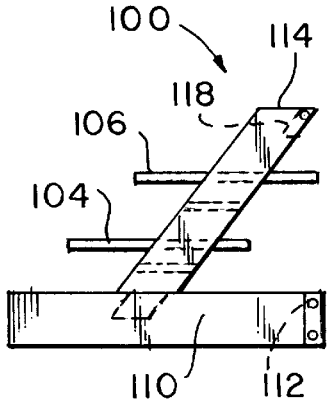
FIG. 15

ADJUSTABLE STORAGE RACK

BACKGROUND OF THE INVENTION

This is a continuation-in-part of application Ser. No. 08/746,997 filed Nov. 19, 1996, now U.S. Pat. No. 5,746,139.

The present invention relates to storage or display racks and, more particularly, to a multiple-shelf rack which can be adjusted to fit within an available storage space.

BRIEF DESCRIPTION OF THE PRIOR ART

Various shelf-type storage devices are known in the patented prior art. The Unfried U.S. Pat. No. 5,411,153, for example, discloses a shelving system made up of a plurality of vertical members, a plurality of horizontal cross members or shelves supported by the vertical members, and a plurality of connectors used to connect the cross members to the vertical members and to connect two vertical members. The width of the shelves is not adjustable and the shelves do not overlap, making this system unsuitable for compact storage.

The Evans U.S. design Pat. No. 324,787 discloses a stackable shoe rack wherein several cage-like baskets may be stacked directly above each other. The individual racks are not adjustable and the design does not allow boots or other items to be neatly stored in a compact manner.

The present invention was developed to overcome these and other drawbacks of the prior devices by providing an improved storage rack system which can be quickly and easily assembled, can be adjusted to fit within an available storage space, and can be added to for increased storage capacity. In this way, boots, plants or the like can be neatly and compactly stored and/or displayed and easily retrieved. The storage rack system includes first and second shelf assemblies arranged generally parallel to each other in an overlapping step-like configuration, supports for supporting the shelf assemblies, and connectors for connecting the shelf assemblies. Each shelf assembly includes a pair of slidably connected horizontal members which allow the width of the shelf assembly to be adjusted. Each horizontal member further includes a molded end portion containing a plurality of bore holes which allow the amount of overlap between the shelf assemblies, and hence the overall depth of the rack, to be adjusted.

SUMMARY OF THE INVENTION

Accordingly, a primary object of the present invention is to provide an adjustable storage rack system which can be adjusted to fit within an available storage space.

It is a more specific object of the invention to provide a storage rack system for boots which includes a frame for receiving and adjustably supporting at least two shelves arranged in parallel spaced relation in a step-like configuration such that the spacing between and overlapping of the shelf assemblies may be varied to best suit the needs of a user.

It is a further object of the present invention to provide a storage rack system which is easy to assemble and which can be build on to, thereby allowing the storage capacity of the rack to be increased as needed.

It is yet another object of the present invention to provide a storage rack system for compactly and neatly storing or displaying boots, plants, or the like which allows the items to be easily retrieved.

It is another object of the present invention to provide an adjustable storage rack system that can be quickly and easily assembled with a minimum amount of fasteners and tools.

BRIEF DESCRIPTION OF THE DRAWINGS

Other objects and advantages of the invention will become apparent from a study of the following specification when viewed in light of the accompanying drawings, in which:

FIG. 2 is a sectional end view of the storage rack system of FIG. 1 with a boot placed thereon;

FIG. 3*a* is a side view of a support member;

FIG. 3*b* is a sectional view taken along line 3*b*—3*b* of FIG. 3*a;*

FIG. 7 is a side view of a connector;

FIG. 8 is a top plan view of the lower shelf assembly;

FIG. 9 is a sectional view taken along line 9—9 of FIG. 8;

FIG. 10 is a bottom plan view of the lower shelf assembly;

FIG. 13 is a perspective view of an alternate embodiment of the adjustable storage rack system according to the invention;

FIG. 14 is a front plan view of the embodiment of FIG. 13;

FIG. 15 is a side plan view of the embodiment of FIG. 13;

DETAILED DESCRIPTION

Figure 1:
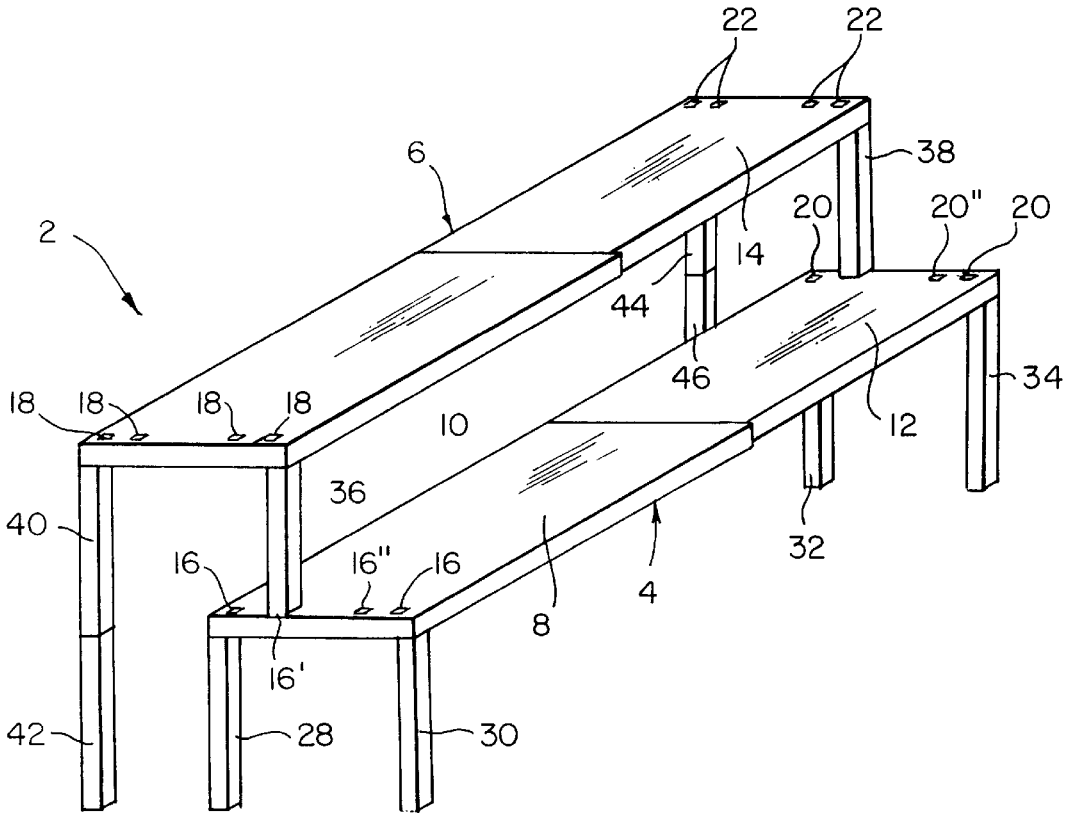
FIG. 1 is a perspective view of the adjustable storage rack system according to the invention.

Referring first to FIGS. 1 and 2, there is shown an adjustable two-tier storage rack system 2 including a lower shelf assembly 4 and an upper shelf assembly 6. The shelf assemblies 4, 6 are arranged in a step-like configuration, whereby upper shelf assembly 6 is generally parallel to and partially overlaps lower shelf assembly 4. By arranging the shelves in this manner, the toe portion of a boot B placed on the lower shelf 4 extends under the upper shelf 6, thereby providing compact storage and easy access for retrieving the boot. It will be recognized that if the shelves are arranged in a conventional non-overlapping step-like configuration, storage space is wasted since the space beneath each shelf remains unused. If, on the other hand, the shelves are arranged vertically directly over each other, space is wasted since the distance between the shelves must be increased to store the items. In addition, stacking the shelves vertically makes retrieving articles more difficult, particularly those articles stored toward the bottom.

Each shelf assembly 4, 6 includes a left half 8, 10 which is slidably connected with a right half 12, 14. Each half 8, 10, 12, 14 contains bore holes 16, 18, 20, 22, respectively, in its top surface and further contains similar bore holes 24, 25 (FIG. 10), 26, respectively, in its bottom surface, each reference numeral representing four bore holes contained in each shelf half. Of course, additional bore holes could be provided to increase the adjustability of the system.

The lower shelf assembly 4 is supported by support legs 28, 30 received in bore holes 24 contained in the bottom of the left half 8 and by support legs 32, 34 which are connected with right half 12 in a similar manner. A pair of connectors 36, 38 connect lower shelf assembly 4 with upper shelf assembly 6. Connector 36 engages a bore hole 16' contained in the top surface of left half 8 and a bore hole 26' contained in the bottom surface of left half 10, thereby connecting left half 8 with left half 10, and connector 38 connects the right halves 12, 14 in a similar manner.

Two pairs of support legs 40, 42 and 44, 46, support left half 10 and right half 14, respectively, at a fixed distance generally parallel with lower shelf assembly 4. Support leg 40 engages a bore hole 26" contained in the bottom of left half 10 and support leg 42 mates with the other end of support leg 40 to form a two piece support structure that supports left half 10 generally parallel to left half 8. Support legs 44 and 46 combine in a similar manner to support right half 14 generally parallel to right half 12. The shelf assemblies and support legs are formed of an injection molded synthetic plastic material, wood, metal, or other suitable material.

FIGS. 3*a* and 3*b* show a support leg 48 representative of each support leg 28, 30, 32, 34, 40, 42, 44, and 46 all of which are designed to be interchangeable. Each support leg includes a body portion 48*a*, a projection 48*b*, and a cavity 50 which is sized to receive the projection from a mating support leg or connector. Accordingly, the height of the storage rack and the distance between the upper and lower shelf assemblies 4, 6 can be varied by stacking or interconnecting any number of support legs and by inserting the appropriate number of support legs under the connectors 36, 38. Thus, the overall height of the rack can be adjusted so it will fit within an available space and the height of the shelf assemblies can be adjusted to accommodate the storage of variously sized items.

Figure 4:
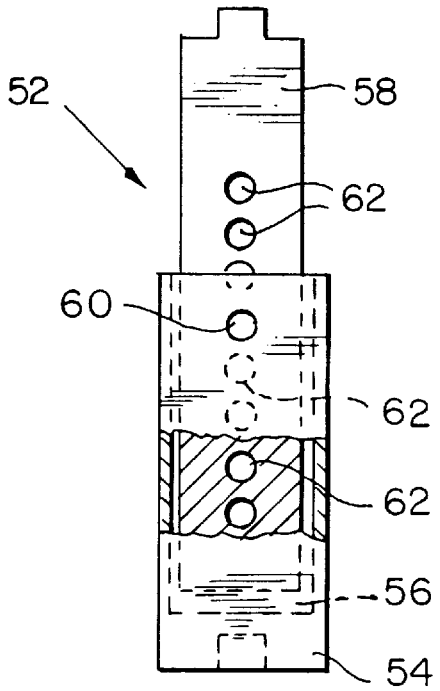
FIG. 4 is a partially sectional view of a telescoping support member.
Figure 5:
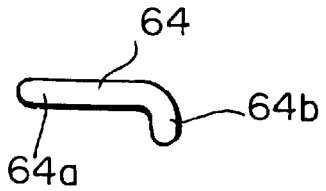
FIG. 5 is a plan view of a lock pin.

FIG. 4 shows an alternate adjustable-length support leg assembly 52 which can be used in place of support leg 48. The assembly includes a female member 54 which contains a channel 56 and a male member 58 which is slidably received in channel 56. Female member 54 contains a bore hole 60 which is aligned with bore holes 62 contained in male member 58. The height of the assembly 52 is adjusted by sliding male member 58 within channel 56. When the desired height is achieved, the male 58 and female 56 members are locked in position relative to one another by inserting a lock pin 64 (FIG. 5) through bore hole 60 and the aligned bore hole in the male member. Lock pin 64 includes a first elongated arm portion 64*a* which extends through the aligned bore holes and a second arm portion 64*b* arranged perpendicular to the first arm portion 64*a* which prevents the lock pin from sliding through the male and female members.

Figure 6B:
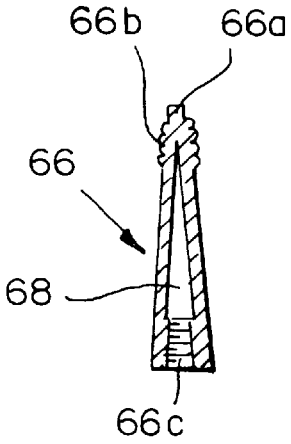
FIG. 6*b* is a sectional view taken along line 6*b*—6*b* of FIG. 6*a;*
Figure 6A:
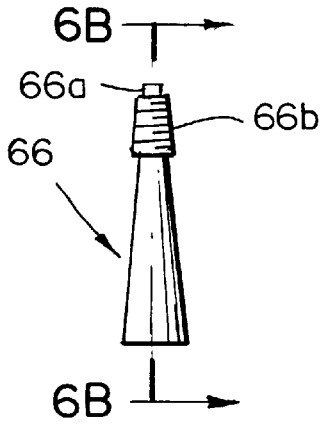
FIG. 6*a* is a side view of a conical support member.

FIGS. 6*a* and 6*b* show another alternate support leg 66 in the form of a hollow frustum having a top 66*a* sized to mate with any of the bore holes contained in the shelf members 8, 10, 12, 14. Straight male threads 66*b*, which mate with corresponding female threads 66*c* contained in the hollow interior 68 of the support leg, are provided on the top of the support leg. The threads allow the top of one support leg to be threaded into the bottom of another, thereby firmly connecting the legs and further allowing the height of the combined leg structure to be accurately adjusted via the threaded connection. Conventional locking means may also be provided to lock the legs in place. It will also be recognized that if the support legs are constructed without threads, the hollow interior 68 allows any number of legs to be stacked vertically to vary the height of an associated shelf assembly.

FIG. 7 shows a connector 70 which is representative of connectors 36 and 38. The connector includes a body portion 70*a* and projections 70*b*, 70*c* at each end sized to engage any of the bore holes contained in the shelf members 8, 10, 12, 14. Accordingly, the overlap of the shelf assemblies 4, 6, and hence the depth of the rack, can be varied by positioning the connectors in the different bore holes contained in the top of the lower shelf assembly, such as 16' and 20' in FIG. 1, or by positioning the connectors in the different bore holes contained in the bottom of the upper shelf assembly. A telescoping configuration similar to the support leg configuration of FIG. 4 may also be used for the connector.

Referring now to FIGS. 8–10, the right half 12 of lower shelf assembly 4 is narrower than the left half 8, thereby allowing the left half to slide longitudinally under the right half, thereby allowing the width of the shelf assemblies to the varied. A mark 72 is provided on the top surface of right half 12 to indicate the maximum extent to which the right and left halves may be separated without sacrificing the structural integrity of the shelf assembly. This ensures that a sufficient amount of overlap, indicated by the X in FIG. 10, exists between the right and left halves. The overlap provides structural integrity to the shelf assembly when item are placed thereon. Alternatively, a stop member which physically prevents separation beyond a predetermined limit may be provided.

As shown in FIG. 9, the left and right halves 8, 12 respectively, include generally planar top portions 8*a*, 12*a*, respectively, side portions 8*b*, 8*c* and 12*b*, 12*c* respectively, and a pari of inwardly extending rail portions 8*d*, 8*e* and 12*d*, 12*e*, respectively. Top portion 8*a*, side portions 8*b*, 8*c* and rail portions 8*d*, 8*e* define a channel which contains right shelf half 12. Rail portions 8*d*, 8*e* further define slide surfaces 74 and 76, respectively, on which rails 12*d* and 12*e*, respectively, slide.

As shown in FIG. 10, each shelf half 8 and 12 includes a molded end portion 8*f*, 12*f* containing bore holes, 24, 25, respectively, which are adapted to receive support legs 28, 30 and 32, 34, respectively.

It will be recognized that even though lower shelf assembly 4 was described in detail, upper shelf assembly 6 is similar to and is designed to be interchangeable with the lower shelf assembly.

Figure 11:
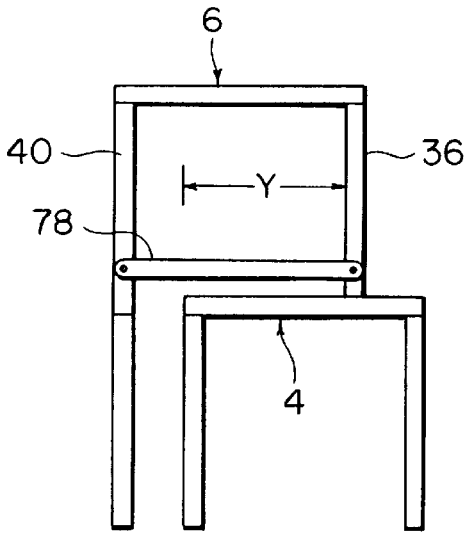
FIG. 11 is an end view of a storage rack system with a support bracket.

FIG. 11 shows the storage rack system of FIGS. 1 and 2 with the position of the connector 36 changed to increase the overlap Y between the lower and upper shelf assemblies. In addition, a bracket 78 is provided between connector 36 and support leg 40 to provide additional stability to the storage rack system. Additional brackets may be provided between other support legs or between the support legs and connectors to provide additional stability as needed.

Figure 12:
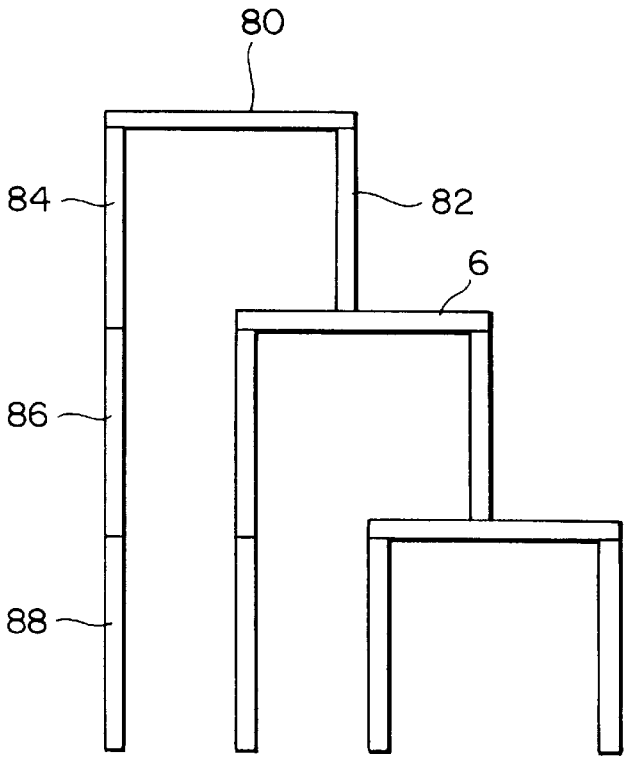
FIG. 12 is an end view of a three-tier storage rack system.

FIG. 12 shows a three-tier storage rack assembly. This rack is similar to the rack of FIGS. 1, 2 and 11 except a third tier has been added, thereby increasing the storage capacity of the rack. The third tier includes a third shelf assembly 80 which includes left and right halves similar to left halves 8 and 10 and right halves 12 and 14, connectors 82 (only one of which is shown) for connecting the third shelf assembly 80 with the second shelf assembly 6, and three support legs 84, 86, 88 for supporting the third shelf assembly generally parallel to the second shelf assembly. It will be recognized that any number of additional tiers may be added to the rack to increase storage capacity and that support brackets may be added to increase the structural stability of the rack.

Figure 16:
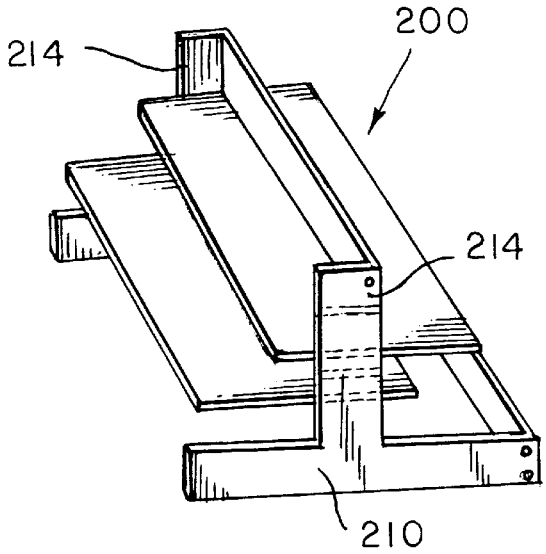
FIG. 16 is a perspective view of an another embodiment of the adjustable storage rack system according to the invention.
Figure 17:
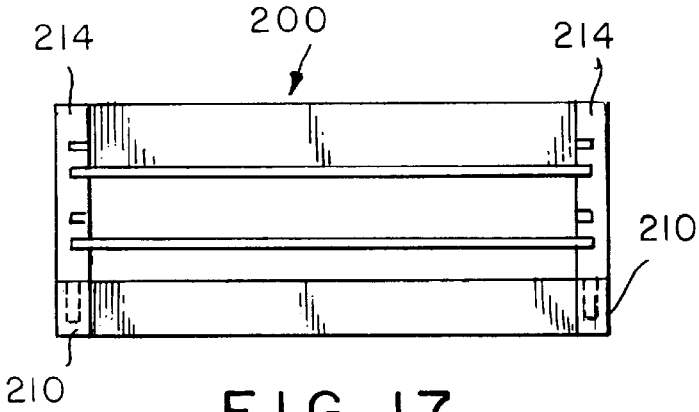
FIG. 17 is a front plan view of the embodiment of FIG. 16.
Figure 18:
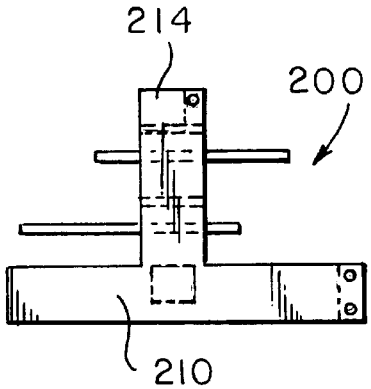
FIG. 18 is a side plan view of the embodiment of FIG. 16.

Referring now to FIG. 13, there is shown an alternate embodiment of the adjustable two tiered storage rack system 100 including a frame 102, a lower shelf 104, and an upper shelf 106 The frame 102 has a base 108 for supporting the storage rack 100. The base 108 is formed from two parallel members 110 and a perpendicular member 112 connected between the rearward ends of members 110 to form a U-shaped structure. The frame 92 further includes two generally vertical supports 114 having a bottom portion that is attached to a middle portion of the parallel members 110. As shown in FIG. 13, the supports 114 extend generally upwardly from the parallel members 100 in an angular fashion towards the rear portion of the parallel members. Alternatively, as shown in FIG. 16, the support members 214 of the storage rack 200 can also extend generally upwardly from the parallel members 210 in a perpendicular fashion. A brace 118 interconnects the top portion of the support members 114.

Figure 19:
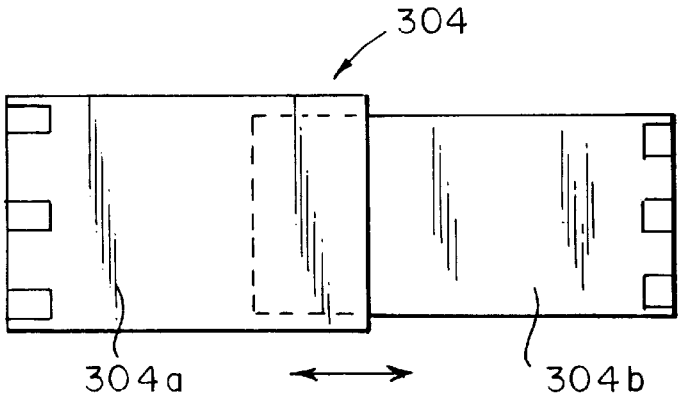
FIG. 19 is a top plan view of an adjustable shelf according to an embodiment of the invention.

Support members 114 contain a plurality of spaced horizontal grooves 120 in an inner surface. The grooves 120 are of sufficient width to receive the end portions of the upper 106 and lower 104 shelves in sliding engagement and support them in place once the shelves are slid into their desired positions within the frame 102. Preferably, the shelves (104, 106) are positioned so that they overlap in a stair-step configuration which causes their front edges to be offset. This configuration facilitates the storage of items, such as boots, by permitting the soles of the boots to be arranged upon a lower shelf while the upper portion of the boot extends upwardly unrestricted by an upper shelf. In FIGS. 19 and 20 are shown an embodiment for an adjustable shelf 304. The shelf comprises first and second slidably connected members 304*a* and 304*b* which enable the overall width of the shelf to be adjusted.

While in accordance with the provisions of the Patent Statutes the preferred forms and embodiments of the invention have been illustrated and described, it will be apparent to those of ordinary skill in the art that various changes and modifications may be made without deviating from the inventive concepts set forth above.

What is claimed is:

1. An adjustable storage rack for boots, comprising (a) a frame, including (1) a generally horizontal base having a U-shaped configuration;

(2) a pair of support members connected with and extending upwardly from opposite sides of said base and perpendicular to said base, said support members each including an inner surface containing a plurality of spaced horizontal grooves; and (3) a brace connected between upper ends of said support members; and (b) at least two shelves each having end portions arranged in said grooves in said support members parallel to and spaced above the base, said shelves having front edges offset from one another in a stair-step configuration, each of said shelves comprising;

(1) a first shelf member; and (2) a second shelf member slidably connected with said first shelf member, whereby the spacing between the shelves, the width of the shelf and the offset arrangement of said shelf front edges are adjustable to accommodate a plurality of boots of different sizes.

2. An adjustable storage rack as defined in claim 1, wherein said base comprises a pair of spaced parallel elongated members and a perpendicular member connected between rear portions of said elongated members.

* * * * *